US005987282A

United States Patent [19]

Tsukamoto et al.

[11] Patent Number: 5,987,282

[45] Date of Patent: Nov. 16, 1999

[54] IMAGE FORMING APPARATUS WITH A DEVELOPING DEVICE USING A DEVELOPING LIQUID

[75] Inventors: Takeo Tsukamoto; Makoto Obu; Sadayuki Iwai, all of Kanagawa, Japan

[73] Assignee: Ricoh Company, Ltd., Tokyo, Japan

[21] Appl. No.: 09/062,833

[22] Filed: Apr. 20, 1998

[30] Foreign Application Priority Data

Apr. 18, 1997 [JP] Japan ..... 9-115119
May 13, 1997 [JP] Japan ..... 9-137498

[51] Int. Cl.[6] ..... G03G 15/10

[52] U.S. Cl. ..... 399/237; 399/239

[58] Field of Search ..... 399/237, 238, 399/239, 240; 430/117–9

[56] References Cited

U.S. PATENT DOCUMENTS 4,218,246 8/1980 Tanaka et al. ..... 430/126
5,652,080 7/1997 Yoshino et al. ..... 430/119
5,666,616 9/1997 Yoshino et al. ..... 399/240
5,708,938 1/1998 Takeuchi et al. ..... 399/250
5,737,666 4/1998 Lior et al. ..... 399/57

*Primary Examiner*—Joan Pendegrass
*Attorney, Agent, or Firm*—Oblon, Spivak, McClelland, Maier & Neustadt, P.C.

[57] ABSTRACT

A developing device of the type using a highly viscous developing liquid is disclosed. The developing liquid applied to a developer carrier in the form of a thin layer is uniformed in order to form a high quality image. The developing liquid is capable of forming desirable images with a constant characteristic even when it is repeatedly used over a long period of time. An image forming apparatus including such a developing device is also disclosed.

16 Claims, 7 Drawing Sheets

IMAGE FORMING APPARATUS WITH A DEVELOPING DEVICE USING A DEVELOPING LIQUID

BACKGROUND OF THE INVENTION

The present invention relates to an electrophotographic copier, facsimile apparatus, laser printer or similar image forming apparatus and, more particularly, to a developing device of the type developing a latent image electrostatically formed on a photoconductive element with a developer implemented by a developing liquid.

An image forming apparatus including a developing device of the type using a highly viscous and dense developing liquid is taught in, e.g., Japanese Patent Laid-Open Publication No. 7-209922 or 7-239615. The conventional apparatus of this type includes a prewetting liquid applying device for applying to a photoconductive element a dielectric prewetting liquid which has a parting ability and is chemically inactive, e.g., dimethyl polysiloxane oil. The photoconductive element with the prewetting liquid is charged and then exposed so as to electrostatically form a latent image thereon. The latent image is developed by a developing device using a highly viscous developing liquid made up of a solvent implemented by dimethyl polysiloxane oil or similar insulating liquid and toner particles densely dispersed in the solvent. The developing liquid is applied to a belt, roller or similar developer carrier in the form of a thin layer by a developer applying device.

A problem with the above developing device is that the developer applying device cannot form a thin uniform liquid layer on the developer carrier without needing several application rollers or even several tens of application rollers. Such a number of application rollers result in a complicated construction and obstruct easy maintenance. Should the number of application rollers be reduced for a simple configuration, a number of ribs would occur on the surface of the thin viscous liquid layer formed on the developer carrier and would make it difficult to uniform the thin liquid layer. The nonuniform liquid layer on the developer carrier degrades the effect available with the prewetting liquid, i.e., the obviation of background contamination of the photoconductive element at the time of development, and fails to develop an image uniformly.

It is also a common practice with the developing device using a developing liquid to collect the developing liquid and prewetting liquid remaining on the developer carrier in a reservoir so as to reuse them. However, repeating the collection of the developing liquid and prewetting liquid is undesirable from in the following respect. The prewetting liquid sequentially increases in amount in the developing liquid used to develop a latent image formed on the photoconductive element. As a result, the toner content, viscosity and other factors of the developing liquid vary and cause the conditions for forming the thin layer on the developer carrier and the amount of toner to deposit on the photoconductive element to vary, deteriorating the image quality.

SUMMARY OF THE INVENTION

It is therefore a first object of the present invention to provide a developing device capable of uniforming a thin layer of a dense developing liquid applied to a developer carrier and thereby insuring high quality images, and an image forming apparatus including the same.

It is a second object of the present invention to provide a developing device capable of forming desirable images with a constant characteristic over a long period of time, and an image forming apparatus including the same.

In accordance with the present invention, a developing device for developing a latent image electrostatically formed on an image carrier by applying, before development, a conductive transparent prewetting liquid to the image carrier and then developing the latent image with a developing liquid includes a developer carrier facing the image carrier in a developing region. A developer applying device applies the developing liquid to the developer carrier in the form of a thin layer. A pressing device presses the thin layer formed on the developer carrier to thereby smooth the surface of a layer of charged toner particles contained in the developing liquid. The pressing device is located downstream of the developer applying device in the direction of movement of the developer carrier.

Also, in accordance with the present invention, an image forming apparatus includes a prewetting liquid applying device for applying, before the development of a latent image electrostatically formed on an image carrier, a conductive transparent prewetting liquid to the image carrier. A developing device develops the latent image with a developing liquid. The developing device includes a developer carrier facing the image carrier in a developing region, a developer applying device for applying the developing liquid to the developer carrier in the form of a thin layer, and a pressing device for pressing the thin layer formed on the developer carrier to thereby smooth the surface of a layer of charged toner particles contained in the developing liquid. The pressing device is located downstream of the developer applying device in the direction of movement of the developer carrier.

Further, in accordance with the present invention, a developing device for developing a latent image electrostatically formed on an image carrier by applying, before development, a conductive transparent prewetting liquid to the image carrier and then developing the latent image with a developing liquid includes a developer carrier facing the image carrier in a developing region. A liquid removing device removes the prewetting liquid and a solvent of the developing liquid from the surface layer of the developing liquid remaining on the developer carrier moved away from the developing region. A cohesion device intervenes between the developing region and the liquid removing device for causing the toner particles remaining on the developer carrier moved away from the developing region to cohere on the developer carrier.

Moreover, in accordance with the present invention, an image forming apparatus includes a prewetting liquid applying device for applying, before the development of a latent image electrostatically formed on an image carrier, a conductive transparent prewetting liquid to the image carrier. A developing device developes the latent image with a developing liquid and includes a developer carrier facing the image carrier in a developing region, a liquid removing device for removing the prewetting liquid and a solvent of the developing liquid from the surface layer of the developing liquid remaining on the developer carrier moved away from the developing region, and a cohesion device intervening between the developing region and the liquid removing device for causing the toner particles remaining on the developer carrier moved away from the developing region to cohere on the developer carrier.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
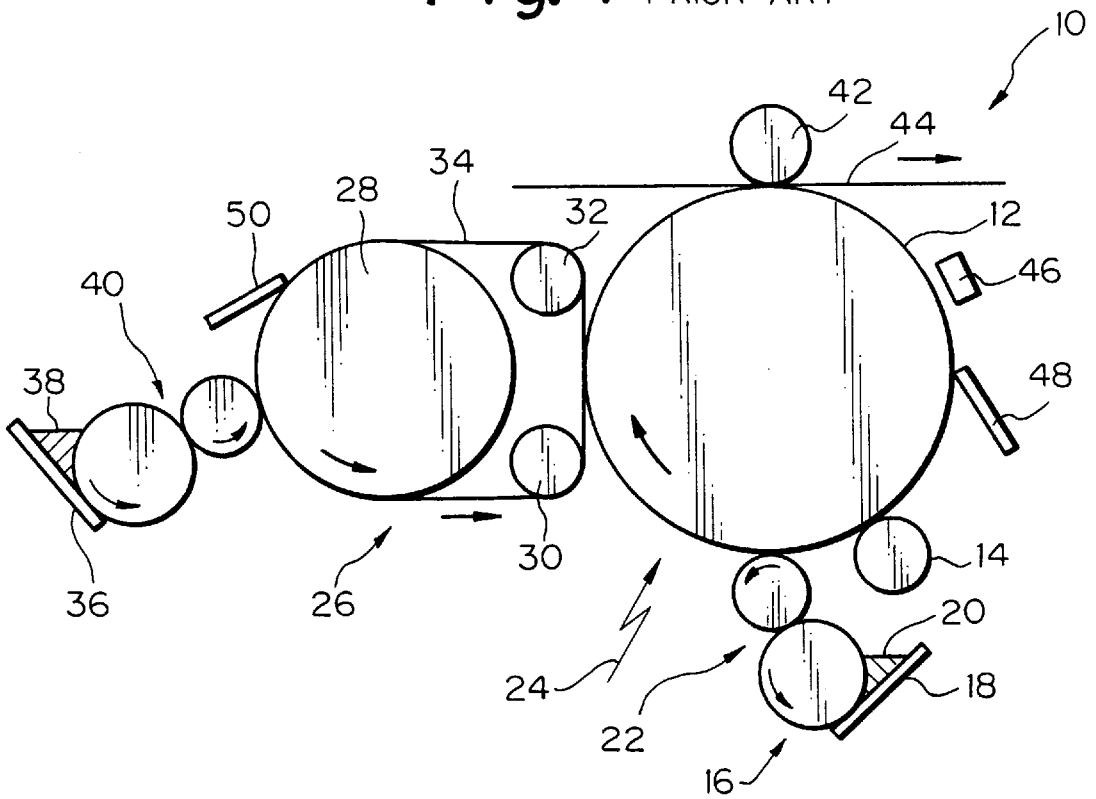
Fig. 1 PRIOR ART
FIG. 1 is a view showing an image forming apparatus including a conventional developing device.

To better understand a preferred embodiment directed toward the first object of the present invention, brief reference wilt be made to an image forming apparatus including a conventional developing device using a highly viscous and dense developing liquid, shown in FIG. 1. As shown, the image forming apparatus, generally 10, includes a photoconductive element in the form of a drum 12 and a charge roller 14 for uniformly charging the drum 12 to positive polarity. A prewetting liquid applying device 16 includes a well 18 storing a dielectric prewetting liquid 20 which has a parting ability and is chemically inactive, e.g., dimethyl polysiloxane oil. A group of application rollers 22 apply the prewetting liquid 20 to the charged surface of the drum 12 to a uniform thickness of several microns. A light beam 24 scans the drum 12 having been coated with the prewetting liquid 20 in order to form an electrostatic latent image thereon. Specifically, charge disappears from the portions of the drum 12 illuminated by the light beam 24, but remains in the portions not illuminated by the same and forms a latent image. The latent image is developed by a developing device 26.

The developing device 26 develops the latent image with a highly viscous developing liquid consisting of a solvent implemented by dimethyl polysiloxane oil or similar insulating liquid and toner particles densely dispersed in the solvent. The developing device 26 includes a belt 34 passed over a plurality of rollers 28, 30 and 32. A group of application rollers 40 apply the developing liquid, labeled 38, stored in a well 36 to the belt 24, causing it to form a thin layer on the belt 24. A bias source, not shown, applies to the belt 34 a potential between the minimum potential and the maximum potential of a latent image to be formed on the drum 12. The surface of the belt 34 is caused to move at the same speed as the surface of the drum 12 in order to form a desirable image in a developing region where the belt 34 and drum 12 contact each other. When the developing liquid 38 forming a thin layer on the belt 34 passes through the developing region while adjoining the drum 12, the toner contained in the liquid 38 is transferred from the belt 34 to the drum 12 in portions where the bias potential of the belt 34 is higher than the potential of the latent image, but not transferred to the drum 12 in the other portions where the former is lower than the latter. The resulting toner image formed on the drum 12 is transferred from the drum 12 to a sheet 44 conveyed by an image transfer roller 42 to which a preselected bias is applied. After the image transfer, a quenching lamp 46 dissipates the charge left on the drum 12, and then a cleaning blade 48 removes the toner left on the drum 12. On the other hand, the toner remaining on the portion of the belt 34 moved away from the developing region is removed by a belt cleaning blade 50.

In the above developing device 26, the developing liquid 38 is applied to the belt 34 by the roller group 40 in the form of a thin layer in the same manner as, e.g., ink applied to a master in an offset printer. The application roller group 40, however, cannot form a thin liquid layer on the belt 34 without needing several rollers or even several tens of rollers, as stated earlier. Such a number of application rollers 40 result in a complicated construction and obstruct easy maintenance. Should the number of application rollers be reduced for a simple configuration, a number of ribs would occur on the surface of the thin viscous liquid layer formed on the belt 34 and would make it difficult to uniform the thin liquid layer.

Further, the developing liquid 38, as distinguished from ink for use in an offset printer, is highly viscous due to toner dispersed with a high content. Therefore, even when application rollers are arranged in a multiple steps as in an offset printer, a number of ribs occur and also make it difficult to uniform the thin liquid layer.

The nonuniform liquid layer on the belt 34 degrades the effect available with the prewetting liquid 20, i.e., the obviation of background contamination of the drum 12 at the time of development, and fails to develop an image uniformly.

Figure 2:
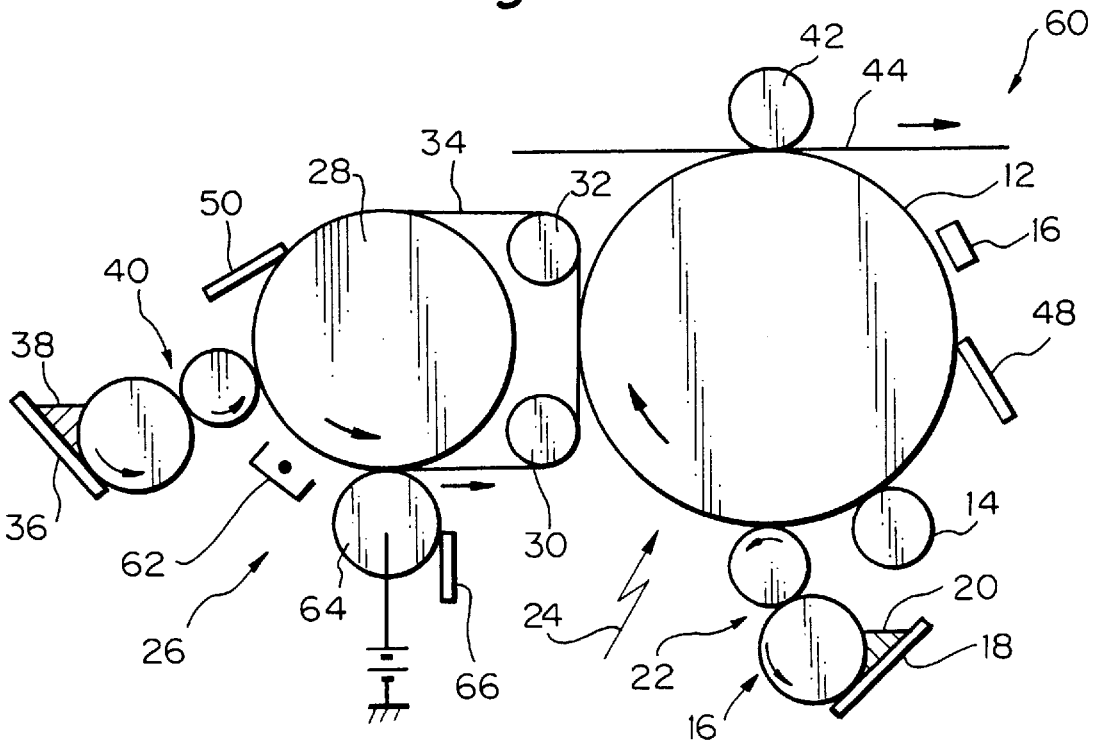
FIG. 2 is a view showing a developing device embodying the present invention and an image forming apparatus including it.

Referring to FIG. 2, a developing device embodying present invention and an image forming apparatus including it will be described. The illustrative embodiment solves the above problems of the conventional developing device, i.e., achieves the first object mentioned previously. In FIG. 2, reference numerals identical with the references numerals of FIG. 1 denote identical structural elements.

As shown in FIG. 2, the image forming apparatus, generally 60, has an image forming and transferring section in which a charge roller 14, a prewetting liquid applying device 16, a developing device 26, an image transfer roller 42, a quenching lamp 16 and a cleaning blade 48 are sequentially arranged around a photoconductive drum 12. The drum 12 is rotatable clockwise, as viewed in FIG. 2. The prewetting liquid applying device 16 includes a well 18 storing a dielectric prewetting liquid 20 which has a parting ability and is chemically inactive, e.g., dimethyl polysiloxane oil. A group of application rollers 22 apply the prewetting liquid 20 to the surface of the drum 12 uniformly charged by the charge roller 14 to positive polarity to a uniform thickness. A light beam 24 scans the drum 12 having been coated with the liquid 20 so as to form an electrostatic latent image. The developing device 26 develops the latent image to thereby produce a corresponding toner image. The image transfer roller 42 transfers the toner image from the drum 12 to a sheet 44. After the image transfer, the charge left on the drum 12 is dissipated by the quenching lamp 16, and then the toner left on the drum 12 is removed by the cleaning blade 48.

The developing device 26 includes a belt 34 passed over a plurality of rollers 28, 30 and 32 and movable counterclockwise at the same peripheral speed as the drum 12, a group of application rollers 40, and a belt cleaning blade 50. In addition, the developing device 26 includes a corona charger 62 and a press roller 64. A potential between the minimum potential and the maximum potential of a latent image to be formed on the drum 12 is applied from a bias source, not shown, to the belt 34. The application roller group 40 applies a developing liquid 38 stored in a well 36 to the belt 34 in the form of a thin layer.

The corona charger 62 and press roller 64 are positioned between the application roller group 40 and a developing region where the belt 34 and drum 12 adjoin each other. The press roller 64 is positioned downstream of the corona charger 62 in the direction of movement of the belt 34. The corona charger 62 injects positive charge into the developer layer formed on the belt 34 by the application roller group 40. As a result, an intense cohesive force acts between the toner particles contained in the developer layer and between the toner particles and the belt 34, causing the toner particles to cohere and form a toner layer on the belt 34.

The press roller 64 presses the toner layer formed on the belt 34 while rotating at the same peripheral speed as the belt 34. The pressure of the press roller 64 acting on the belt 34 is selected such that it does not cause the developing liquid to accumulate at the upstream side of the position where the press roller 64 and belt 34 contact each other. The pressure would lower the toner particle pressing effect if excessively low or would prevent the toner layer from passing through the above position if excessively high. The press roller 64 is implemented by a conductive member whose surface is covered with a high resistance material, e.g., an aluminum roller whose surface is subjected to hard Alumite treatment. A bias is applied to the press roller 64 such that the surface potential of the roller 64 is higher than the surface potential of the belt 34. The potential difference between the press roller 64 and the belt 34 should preferably be as great as possible within a range not causing discharge to occur in the nip between them. A cleaning blade 66 is held in contact with the press roller 64 in order to remove the developer, mainly solvent, deposited on the roller 64.

Figure 3:
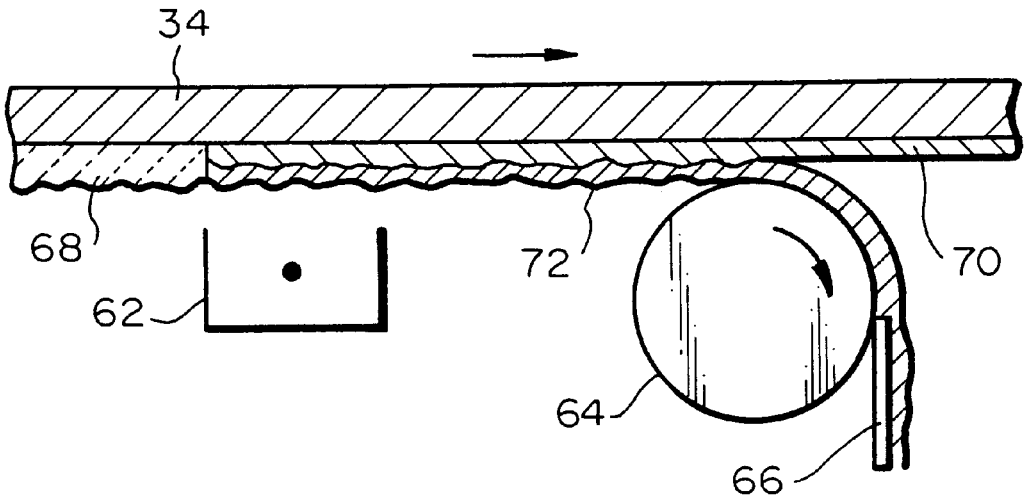
FIGS. 3–6 are views demonstrating the operation of the illustrative embodiment.

Reference will be made to FIG. 3 for describing how the toner particles contained in the developing liquid 38 forming a layer on the belt 34 are caused to cohere and smoothed. As shown, the developing liquid 38 applied to the belt 34 by the application roller group 40 forms a layer 68 which is several microns to several ten microns thick. Because the layer 68 is highly viscous due to the toner densely dispersed therein, the layer 68 has ribs and other irregularities on its surface, as illustrated. Such irregularities are conspicuous in the direction perpendicular to the direction of movement of the belt 34. The corona charger 62 injects charge into the layer 68 so as to cause an intense cohesive force to act between the toner particles and between the toner particles and the belt 34. The toner particles cohered together form a toner layer 70 on the belt 34; a solvent layer 72 separate from the toner layer 70 appears on the toner layer 70. While the toner layer 70 is a developer layer having an increased toner content, the solvent layer 72 is a developer layer whose toner content is extremely low. When the toner layer 70 arrives at the press roller 64, it is pressed by a preselected force in contact with the roller 64 and has its surface smoothed thereby. At this instant, because the surface potential of the press roller 64 is higher than the surface potential of the belt 34, as stated earlier, the deposition of the toner particles on the roller 64 can be restricted, i.e., the toner layer 70 can be uniformly pressed. Because the surface of the press roller 64 is formed of a high resistance material, electric leakage between the roller 64 and the belt 34 is obviated, so that the surface of the toner layer 70 can be stably smoothed.

The solvent layer 72 intervening between the toner layer 70 and the press roller 64 is deposited on the roller 64 and peeled off from the belt 34. The cleaning blade 66 removes the solvent layer 72 from the press roller 64 so as to maintain the surface of the roller 64 clean at all times. The press roller 64 can therefore smooth the surface of the toner layer 70 continuously in a stable manner. Moreover, because the solvent layer 72 is removed from the press roller 64 by the cleaning blade 66, a needless liquid nip is prevented from being formed at the upstream side with respect to the position where the roller 64 and belt 34 contact each other. This minimizes the ribs of the toner layer 70 and solvent layer 72 newly formed at the downstream side with respect to the above position.

The toner layer 70 provided with a smooth surface and a uniform density by the above procedure develops the latent image formed on the drum 12. The resulting toner image is therefore desirably uniform, i.e., free from irregularity in density.

Figure 4:
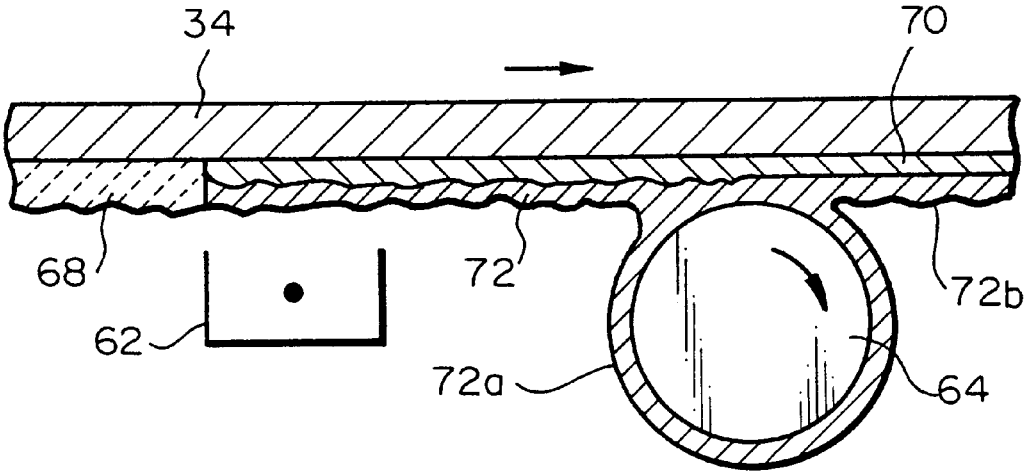

The above advantages are achievable even when the cleaning blade 66 associated with the press roller 64 is absent, as follows. As shown in FIG. 4, assume that the cleaning blade 66 is absent. Then, the solvent layer 72 deposited on the press roller 64 remains steadily while forming a layer 72*a* of certain thickness on the surface of the roller 64. Not only the toner layer 70 but also a solvent layer 72 remain on the part of the belt 34 moved away from the press roller 64. Irregularities newly produced by the press roller 64 are present on the surface of the solvent layer 72*b*. However, because the surface of the cohered toner layer 70 is smoothed by the press roller 64, the irregular density distribution of the final image can be reduced. More specifically, although the cohered toner layer 70 cannot have its irregular surface smoothed by the weak pressure of the drum 12, the solvent layer 72*b* can have its irregular surface easily smoothed when brought into contact with the drum 12.

Figure 5:
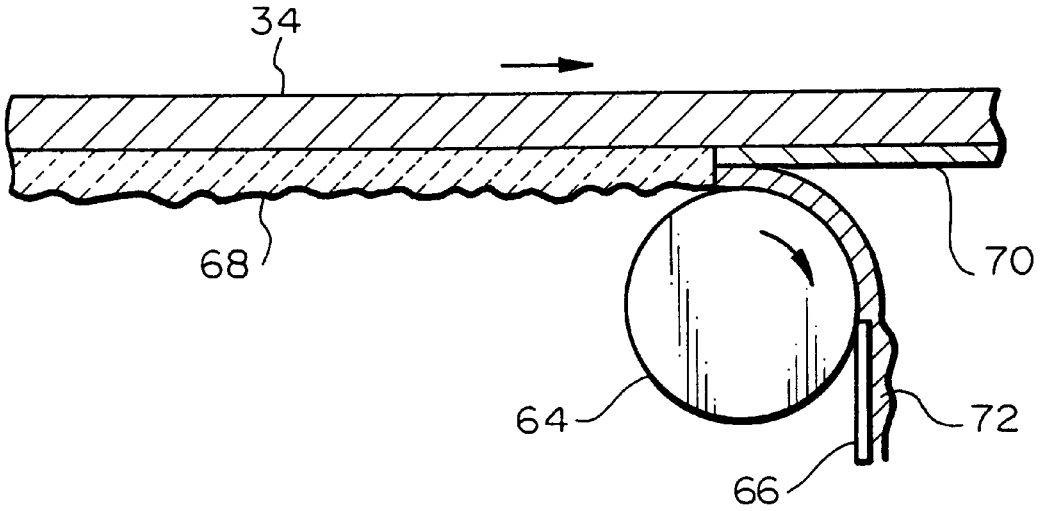
Figure 6:
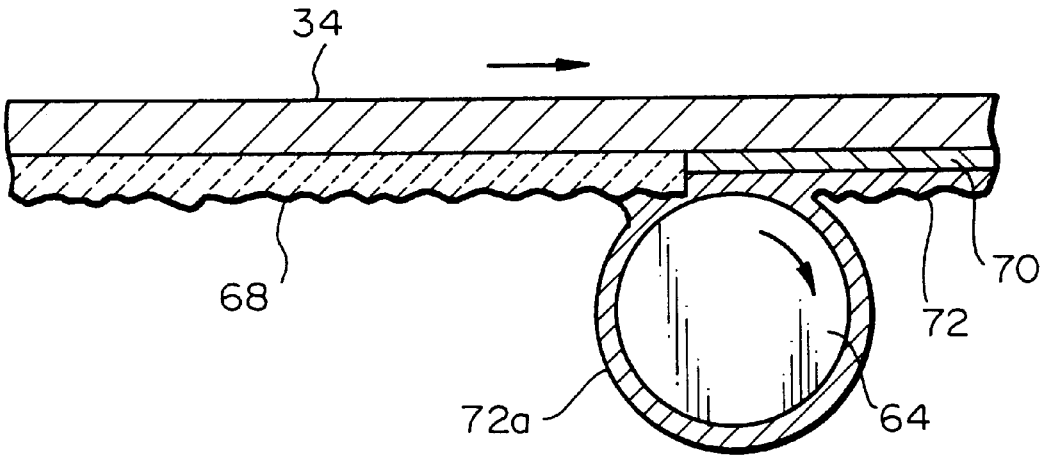

Further, even when the corona charger 62 is omitted, the toner of the developer layer 68 can cohere and form the toner layer 70 separate from the solvent layer 72 and allows the surface of the toner layer 70 to be smoothed. Specifically, as shown in FIGS. 5 and 6, the bias potential applied to the press roller 64 causes the toner of the developer layer 68 to cohere and form the toner layer 70 separate from the solvent layer 72 at the position where the press roller 64 is located. At the same time, the surface of the toner layer 70 is smoothed by the press roller 64. When the corona charger 62 is absent, although a greater amount of toner particles is apt to remain in the solvent layer 72 than when the corona charger 62 is present, the toner layer 72 can be surely smoothed because the press roller 64 separates the toner layer 70 and solvent layer 72 and presses the toner layer 70 at the same time.

The above embodiment achieves the following various advantages.

(1) The application roller group applies the developing liquid to the surface of the belt in a form of a thin developer layer. The pressing device presses the thin developer layer with a preselected force so as to smooth the surface of the layer. The developer layer with the smoothed toner is conveyed to the developing region in order to develop a latent image formed on the photoconductive drum or image carrier. Therefore, a desirable toner image free from irregularity in density can be formed on the drum.

(2) Before the surface of the developer layer has been smoothed, the corona charger injects charge into the developer layer in order to cause an intense cohesive force to act between the toner particles of the developer layer and between the toner particles and the belt. As a result, the toner particles cohere and form a toner layer on the belt. Because the surface of such a toner layer is smoothed, a desirable toner image free from irregularity in density can be stably formed on the drum.

(3) The pressing device is implemented as a press roller or rotatable member and can press the toner layer evenly. This provides the toner layer with uniform density and thereby allows a desirable toner image to be stably formed on the drum.

(4) When the surface of the toner layer is smoothed, a bias potential is applied to the press roller such that the press roller has a higher surface potential than the belt. In this condition, the toner particles are prevented from depositing on the press roller, so that the toner layer can be pressed by a uniform force.

(5) Because the press roller has its surface implemented by a high resistance material, electric leakage between the press roller and the belt is obviated. Therefore, the surface of the toner layer can be stably smoothed.

(6) The solvent layer deposited on the press roller is removed by the cleaning blade. This maintains the surface of the press roller clean at all times and thereby allows the surface of the toner layer to be continuously smoothed.

(7) Because the bias potential is applied to the press roller, the cohesion of the toner and the smoothing of the surface of the toner layer can be implemented by the press roller even if the corona charger is absent. This simplifies the configuration of the developing device.

An alternative embodiment of the present invention capable of achieving the second object will be described hereinafter. To better understand the alternative embodiment, brief reference will be made to an image forming apparatus including a developing device different from the developing device of FIG. 1, shown in FIG. 7. As shown, the image forming apparatus, generally 80, includes a prewetting liquid applying device 82. The device 82 uniformly applies to a photoconductive drum 84 a dielectric prewetting liquid which has a parting ability and is chemically inactive, e.g., dimethyl polysiloxane oil. After a charger 86 has charged the drum 84 coated with the prewetting liquid, a light beam 88 scans the drum 84 so as to form an electrostatic latent image thereon. At this instant, the charge of the drum 84 disappears in the portions illuminated by the light beam 88, but remains in the portions not illuminated and forms the latent image. A developing device 90 develops the latent image to thereby produce a corresponding toner image. Specifically, the developing device 90 develops the latent image with a highly viscous developing liquid consisting of dimethyl polysiloxane oil or similar insulating solvent and toner particles densely dispersed in the solvent. The developing liquid, or simply developer, is fed from a reservoir 92 to a layer forming roller 98 by a pump 94. The layer forming roller 96 applies the developer to a developing roller 98 in the form of a thin layer.

Figure 7:
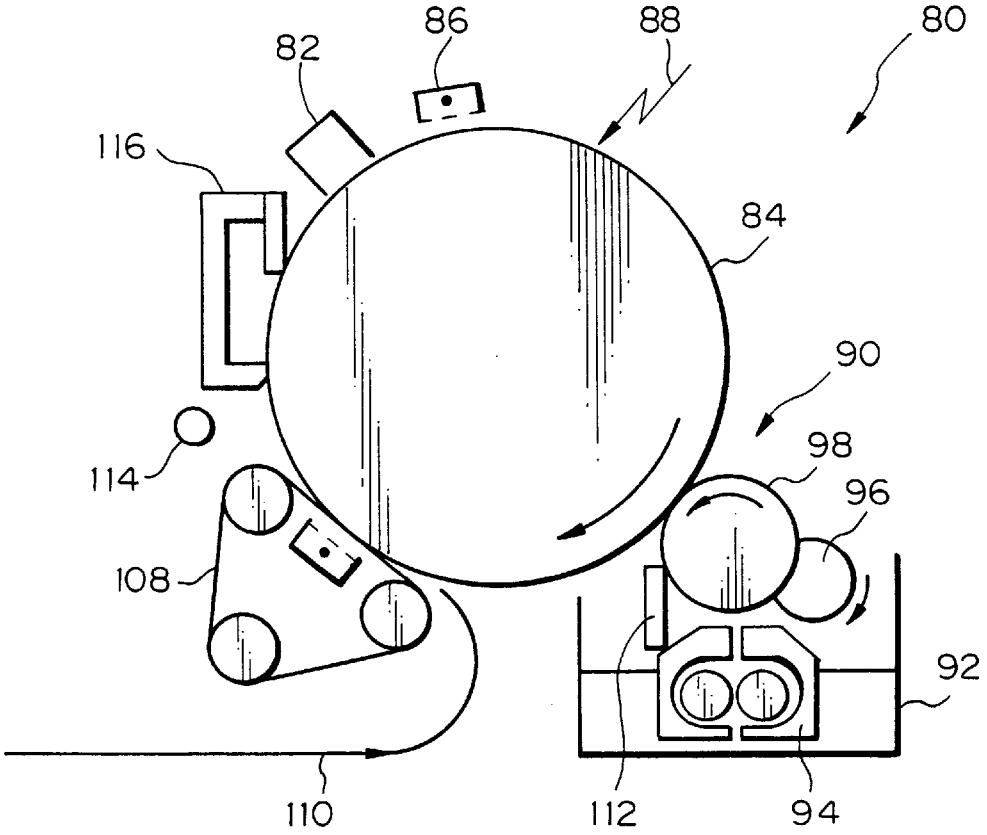
Fig. 7 PRIOR ART
FIG. 7 is a view showing an image forming apparatus including another conventional developing device.
Figure 8:
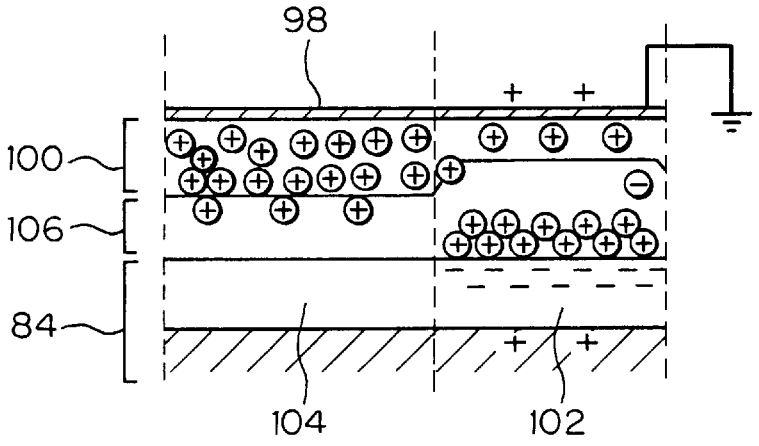
Fig. 8 PRIOR ART
FIG. 8 schematically shows toner particles existing in a developing region include the apparatus of FIG. 7.

As shown in FIG. 8, when a thin developer layer 100 formed on the developing roller 98 passes through the developing region in the vicinity of the drum 84, the charged toner contained in the layer 100 moves to and deposits on the image portion 102 of the drum 84 due to an electrostatic force, developing the image portion 102. By contrast, no electrostatic forces act on the toner present in the part of the developer layer 100 contacting the non-image portion 104 of the drum 84 from which the charge has disappeared. This, coupled with the fact that the surface of the drum 84 and the developer layer 100 are separated from each other by a prewetting liquid layer 106, the above toner does not deposit on the non-image portion 104; otherwise, the toner would deteriorate the image. The resulting toner image is transferred from the drum 84 to a sheet 110 by an image transfer unit 108 and then fixed on the sheet 110 by a fixing unit, not shown. In FIG. 7, there are also shown a discharger 114 and a cleaning unit 116.

Figure 9:
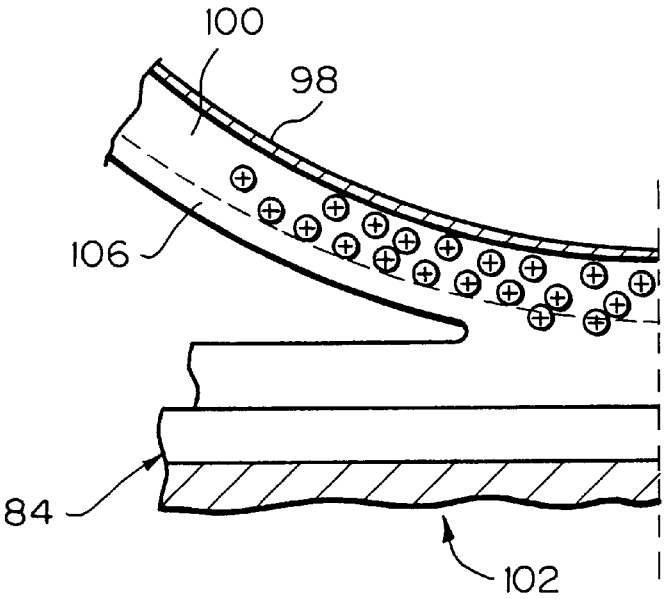
Fig. 9 PRIOR ART
FIG. 9 shows how a prewetting liquid is separated in a non-image portion in the apparatus of FIG. 7.
Figure 10:
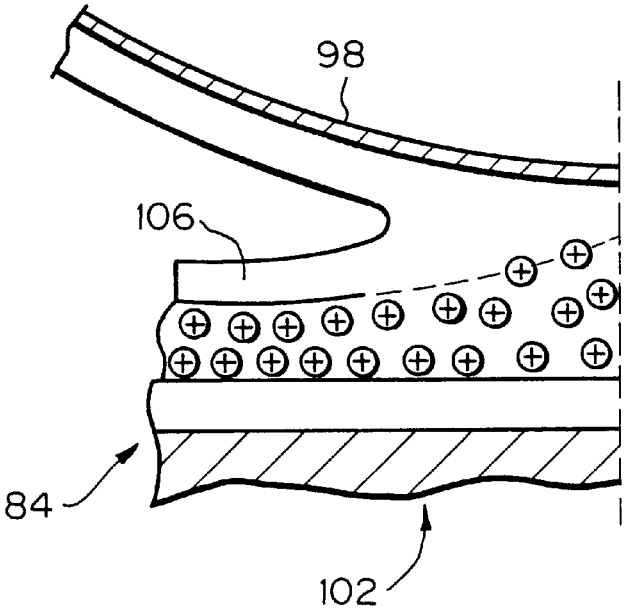
Fig. 10 PRIOR ART
FIG. 10 shows how a prewetting liquid is separated in an image portion in the apparatus of FIG. 7.

When the developer on the developing roller 98 moves away from the developing region and separates from the drum 84, the toner corresponding to the non-image portion 104 remains in the developer layer 100 on the roller 98, as shown in FIG. 9. At the interface between the prewetting liquid layer 106 on the drum 84 and the developer layer 100, the prewetting liquid is partly transferred to the developer due to its low viscosity. Further, in the image portion 102, the prewetting liquid overlies the toner deposited on the drum 84, as shown in FIG. 10, and is also partly transferred to the solvent of the developer. The developer and prewetting liquid remaining on the developing roller 98 moved away from the developing region is scraped off by a blade 112 and returned to the reservoir 92. These liquids collected in the tank 92 are agitated for reuse.

However, collecting the developer and prewetting liquid remaining on the developing roller 98 in the reservoir 92, as stated above, is undesirable from in the following respect. The prewetting liquid sequentially increases in amount in the developing liquid used to develop a latent image formed on the drum 84. As a result, the toner content, viscosity and other factors of the developing liquid vary and cause the conditions for forming the thin layer on the developing roller 98 and the amount of toner to deposit on the drum 84 to vary, deteriorating the image quality.

Briefly, the alternative embodiment of the present invention to be described maintains the characteristic of the developing liquid constant and thereby insures high image quality even when the liquid is continuously used over a long period of time.

Figure 11:
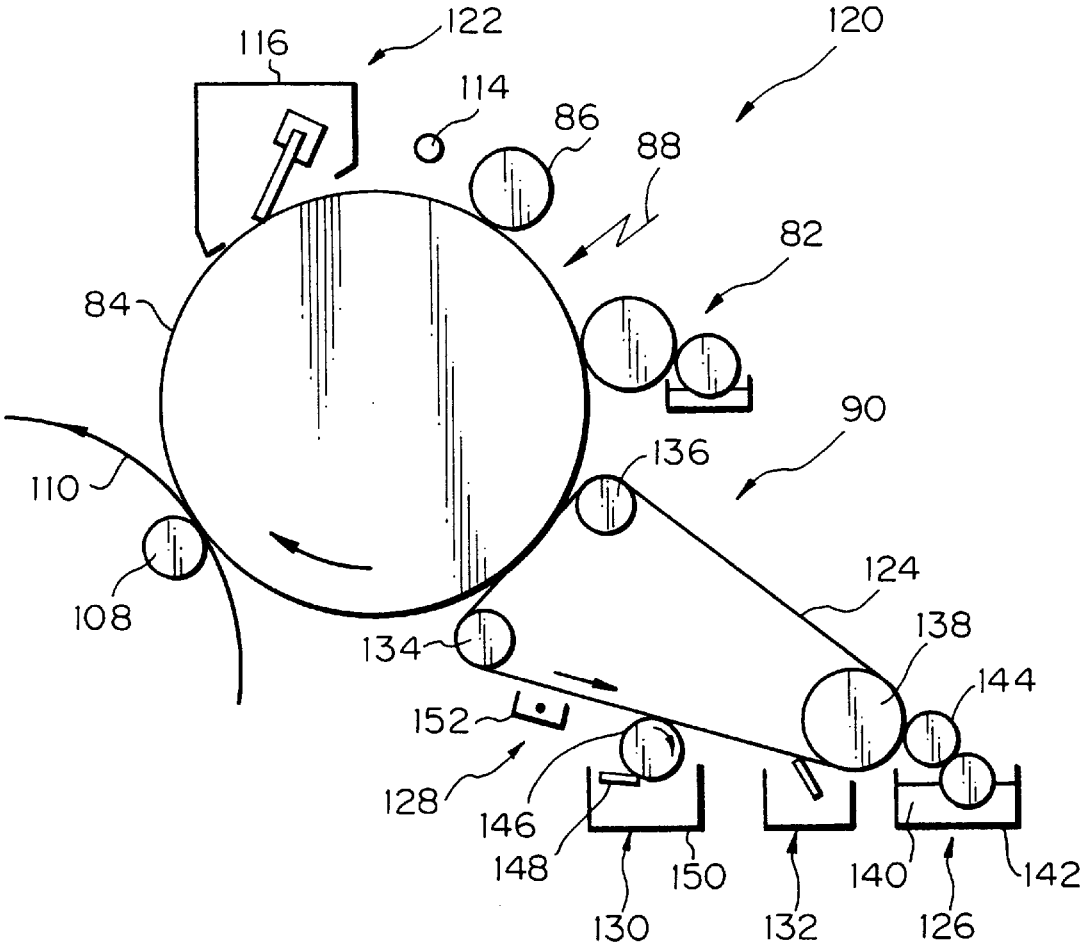
FIG. 11 is a view showing an alternative embodiment of the present invention.

Referring to FIG. 11, the alternative embodiment is implemented as an image forming apparatus 120 including an image forming and transferring section 122. In this section 122, the charger 86, prewetting liquid applying device 82, developing device 90, image transfer unit 108, cleaning unit 116 and discharger 114 are arranged around the drum 84. The light beam 88 scans the surface of the drum 84 charged by the charger 86, thereby forming a latent image on the drum 84. The prewetting liquid applying device 82 uniformly applies to the scanned surface of the drum 84 the dielectric prewetting liquid which has a parting ability and is chemically inactive, e.g., dimethyl polysiloxane oil. Thereafter, the developing device 90 develops the latent image of the drum 84 with the developing liquid.

The developing liquid consists of a solvent and toner densely dispersed in the solvent and is therefore highly viscous. The solvent may be implemented by, e.g., dimethyl polysiloxane oil like the prewetting liquid or may be implemented by an insulating liquid different in characteristic from the prewetting liquid. The toner image formed on the drum 84 is transferred to the sheet 110 by the image transfer unit 108 and then fixed on the sheet 110 by a fixing unit, not shown, using heat and pressure. After the image transfer, the toner left on the drum 84 is removed by the cleaning unit 116, and then the charge also left on the drum 84 is dissipated by the discharger 114.

The developing device 90 includes a belt 124 passed over a drive roller 134 and driven rollers 136 and 138, a developer applying device 126, a particle cohesion device 128, a liquid removing device 130, and a toner collecting device 132. A potential between the minimum potential and the maximum potential of a latent image to be formed on the drum 84 is applied from a bias source, not shown, to the belt 124. The developer applying device 126 includes a reservoir 142 storing a developing liquid, or simply developer, 140, and a group of application rollers 144. The roller group 144 applies the developing liquid 140 to the surface of the belt 124 in the form of a thin layer.

The liquid removing device 130 is located downstream of a developing region where the belt 124 contacts the drum 84 in the direction of movement of the belt 124, but upstream of the developer applying device 126. The device 130 removes the prewetting liquid and the solvent of the developer remaining on the belt 124 moved away from the developing region. The device 130 includes a collection roller 146, a blade 148, and a collection tank 150. The collection roller .146 is held in light contact with the surface of the belt 124 and movable in the same direction as the belt 124. The collection roller 146 may be implemented by a conductive porous roller formed of, e.g., foam urethane containing carbon black or similar conductive powder, or a metal roller having a resistance layer on its surface. A positive bias voltage is applied to the collection roller 146.

The particle cohesion device 128 includes a corona charger 152 located downstream of the developing region in the direction of the movement of the belt 124, but upstream of the liquid removing device 130. The corona charger 152 faces the surface of the belt 124. A high positive bias is applied to the corona charger 152 and causes it to emit positive ions toward the toner remaining on the belt 124 moved away from the developing region. The toner collecting device 132 collects the toner remaining on the belt 124 moved away from the developing region.

In operation, the developer applying device 126 causes its application roller group 144 to apply the developing liquid 140 stored in the reservoir 142 to the surface of the belt 124 in the form of a thin layer. The belt 124 with the thin developer layer moves at the same speed and in the same direction as the drum 84 in contact with the drum 84, thereby developing a latent image electrostatically formed on the drum 84. At this instant, the thin developer layer is brought into contact with the layer of the prewetting liquid present on the drum 84, so that the pressure of the thin developer layer is uniformly distributed. This successfully prevents the developer layer from being locally crushed and disturbing the image.

Figure 12:
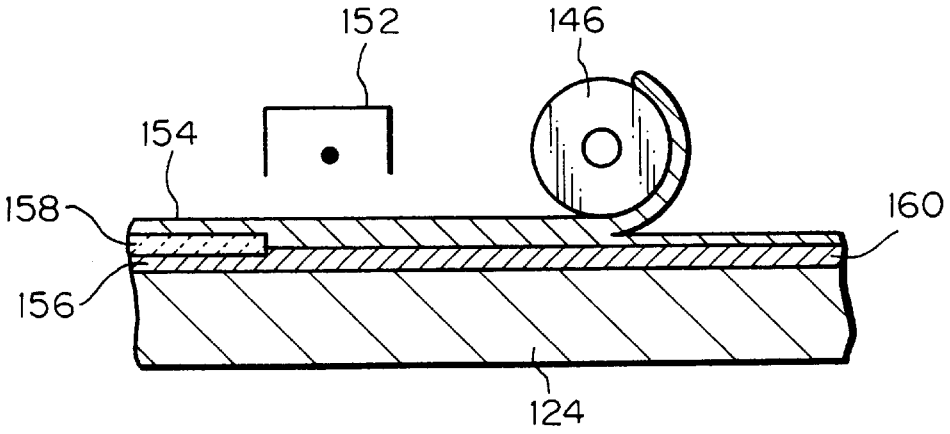
FIG. 12 shows the operation of the alternative embodiment.

As shown in FIGS. 9 and 10, at the downstream side of the developing region where the belt 124 contacts the drum 84, the prewetting liquid layer 106 is transferred to the surface of the developer layer 100 corresponding to the non-image portion and containing the toner. As shown in FIG. 12, a liquid layer 154 consisting of the prewetting liquid and the solvent of the developer, a residual toner layer 156, and a dispersion layer 158 in which the toner is dispersed in the prewetting liquid and solvent are present on the surface of the belt 124 moved away from the developing region. The corona charger 152 emits positive ions toward the toner so remaining on the belt 124 and constituting the residual toner layer 156 and dispersion layer 158. As a result, this part of the toner coheres around the surface layer of the belt 124 due to electrostatic attraction, forming a cohered toner layer 160 separate from the liquid layer 154, as shown in FIG. 12.

When the belt 124 carrying the liquid layer 154 and cohered toner layer 160 thereon arrives as the liquid removing device 130, the device 130 removes and collects the prewetting liquid and solvent from the belt 124. At this instant, the prewetting liquid, the solvent layer 154 and the cohered toner layer 160 are separate from each other, so that only the liquid layer 154 can be surely collected by the collection roller 146. It follows that the toner is prevented from being introduced into the liquid collected in the tank 150. Therefore, the liquid collected in the tank 150 can be reused after simple treatment.

The part of the liquid layer 154 and the cohered toner layer 160 remaining on the belt 124 moved away from the liquid removing device 130 are collected by the toner collecting device 132. The prevents the prewetting liquid from being introduced into the developing liquid 140 stored in the reservoir 142. It follows that latent images can be desirably developed by the developer 140 having a constant characteristic over a long period of time.

Figure 13:
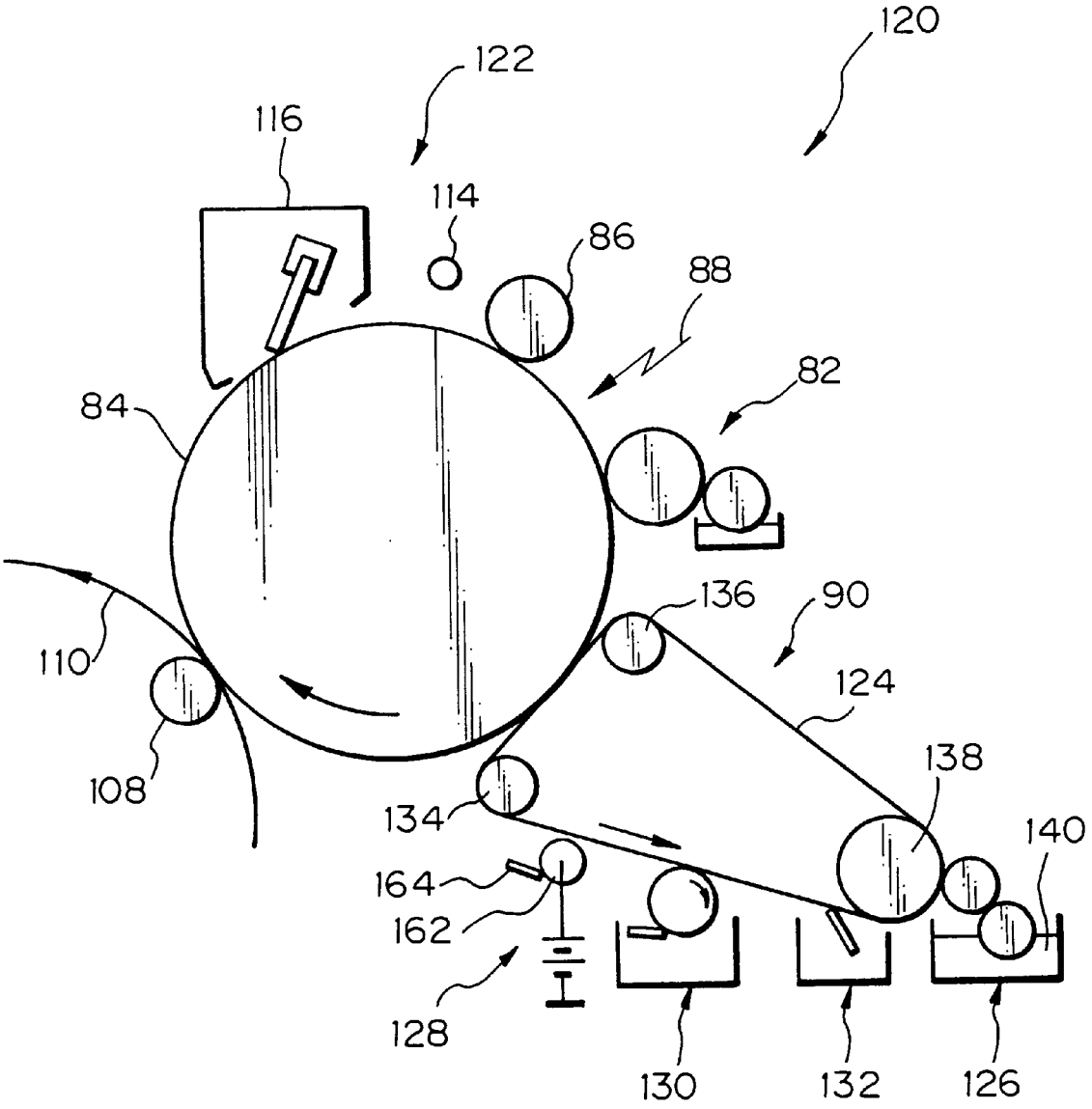
FIG. 13 shows a modification of the alternative embodiment.

In the above embodiment, the particle cohesion device 128 is implemented as the corona charger 152 adjoining the surface of the belt 124. Alternatively, as shown in FIG. 13, the device 128 may be implemented as a charge roller 162 spaced from the surface of the belt 124 by a preselected distance. In this case, the prewetting liquid, for example, accidentally deposited on the charge roller 162 would vary the charging characteristic of the roller 162. In light of this, a cleaning blade 164 is held in contact with the charge roller 162 in order to constantly clean the roller 162. This allows the toner remaining on the belt 124 to cohere stably.

The alternative embodiment shown and described has the following advantages.

(1) The liquid removing device is positioned downstream of the developing region where the developer carrier contacts the image carrier in the direction of movement of the belt, but upstream of the position where the developing liquid is applied to the developer carrier. The liquid removing device removes the prewetting liquid and the solvent of the developing liquid remaining on the developer carrier moved away from the developing region. This prevents the prewetting liquid from being mixed with the developing liquid existing in a reservoir, and thereby allows the developing liquid to produce high quality images with a constant characteristic over a long period of time.

(2) Before the removal of the prewetting liquid and solvent remaining on the belt moved away from the developing region, the toner present in the prewetting liquid and solvent is caused to cohere around the surface of the belt and form a cohered toner layer separate from the liquid layer. Therefore, only the liquid layer can be collected at the time of removal of the prewetting liquid and solvent, i.e., the toner is prevented from being introduced into the collected prewetting liquid and solvent. This allows the collected liquid to be reused after simple treatment.

(3) The toner remaining on the belt can be easily and surely caused to cohere by the corona charger or the charge roller having a simple configuration.

Various modifications will become possible for those skilled in the art after receiving the teachings of the present disclosure without departing from the scope thereof.

What is claimed is:

1. A developing device for developing a latent image electrostatically formed on an image carrier by applying, before development, a dielectric transparent prewetting liquid to said image carrier and then developing the latent image with a developing liquid, said developing device comprising:

a developer carrier facing the image carrier in a developing region;

developer applying means for applying the developing liquid to said developer carrier in a form of a thin layer;

pressing means for pressing said thin layer formed on said developer carrier to thereby smooth a surface of a layer of charged toner particles contained in the developing liquid, said pressing means being located downstream of said developer applying means in a direction of movement of said developer carrier; and liquid removing means for removing the prewetting liquid and a solvent of the developing liquid from a surface layer of the developing liquid remaining on said developer carrier moved away from said developing region.

2. A developing device as claimed in claim 1, further comprising layer forming means intervening between said developer applying means and said pressing means for causing the toner particles present in said thin layer to cohere.

3. A developing device as claimed in claim 2, wherein said pressing means comprises a roller adjoining a surface of said developer carrier.

4. A developing device as claimed in claim 3, wherein a bias potential for attracting the toner particles toward the surface of said developer carrier is applied to said roller.

5. A developing device as claimed in claim 4, further comprising cleaning means for removing the developing liquid and a solvent of the developing liquid from a surface of said roller.

6. A developing device as claimed in claim 4, wherein said roller comprises a charge roller made up of a conductive member and a high resistance member covering a surface of said conductive member.

7. A developing device as claimed in claim 1, wherein said liquid removing means is configured to remove the prewetting liquid and the solvent from said developer carrier without substantially removing the toner particles remaining on said developer carrier.

8. A developing device for developing a latent image electrostatically formed on an image carrier by applying, before development, a dielectric transparent prewetting liquid to said image carrier and then developing the latent image with a developing liquid, said developing device comprising:

a developer carrier facing the image carrier in a developing region;

developer applying means for applying the developing liquid to said developer carrier in a form of a thin layer;

pressing means for pressing said thin layer formed on said developer carrier to thereby smooth a surface of a layer of charged toner particles contained in the developing liquid, said pressing means being located downstream of said developer applying means in a direction of movement of said developer carrier;

liquid removing means for removing the prewetting liquid and a solvent of the developing liquid from a surface layer of the developing liquid remaining on said developer carrier moved away from said developing region; and cohesion means intervening between said developing region and said liquid removing means for causing the toner particles remaining on said developer carrier moved away from said developing region to cohere on said developer carrier.

9. A developing device as claimed in claim 8, wherein said cohesion means comprises charging means adjoining a surface of said developer carrier.

10. A developing device as claimed in claim 9, wherein said charging means comprises a corona charger including a wire.

11. A developing device as claimed in claim 9, wherein said charging means comprises a charge roller.

12. A developing device for developing a latent image electrostatically formed on an image carrier by applying, before development, a dielectric transparent prewetting liquid to said image carrier and then developing the latent image with a developing liquid, said developing device comprising:

a developer carrier facing the image carrier in a developing region;

liquid removing means for removing the prewetting liquid and a solvent of the developing liquid from a surface layer of the developing liquid remaining on said developer carrier moved away from said developing region; and cohesion means intervening between said developing region and said liquid removing means for causing the toner particles remaining on said developer carrier moved away from said developing region to cohere on said developer carrier.

13. A developing device as claimed in claim 12, wherein said cohesion means comprises charging means adjoining a surface of said developer carrier.

14. A developing device as claimed in claim 13, wherein said charging means comprises a corona charger including a wire.

15. A developing device as claimed in claim 13, wherein said charging means comprises a charge roller.

16. An image forming apparatus comprising:

a prewetting liquid applying device for applying, before development of a latent image electrostatically formed on an image carrier, a dielectric transparent prewetting liquid to said image carrier;

a developing device for developing the latent image with a developing liquid;

said developing device comprising:

a developer carrier facing the image carrier in a developing region;

liquid removing means for removing the prewetting liquid and a solvent of the developing liquid from a surface layer of the developing liquid remaining on said developer carrier moved away from said developing region; and cohesion means intervening between said developing region and said liquid removing means for causing the toner particles remaining on said developer carrier moved away from said developing region to cohere on said developer carrier.

* * * * *